United States Patent [19]

Hildebrand et al.

[11] 4,372,744

[45] Feb. 8, 1983

[54] PROCESS FOR DYEING CELLULOSE MATERIALS WITH REACTIVE DYESTUFFS BY THE EXHAUSTION METHOD

[75] Inventors: Dietrich Hildebrand, Odenthal, Fed. Rep. of Germany; Franz Haas, Dornbirn, Austria

[73] Assignee: Bayer Aktiengesellschaft, Leverkusen, Fed. Rep. of Germany

[21] Appl. No.: 132,053

[22] Filed: Mar. 20, 1980

[30] Foreign Application Priority Data

Apr. 7, 1979 [DE] Fed. Rep. of Germany ..... 2914111

[51] Int. Cl.[3] ..... D06P 3/66; D06P 5/00

[52] U.S. Cl. ..... 8/400; 8/543; 8/918; 8/932

[58] Field of Search ..... 8/400, 543, 918, 932

[56] References Cited

U.S. PATENT DOCUMENTS

| | | | |
|---|---|---|---|
| 3,031,252 | 4/1962 | Staeuble et al. | 8/543 |
| 3,843,318 | 10/1974 | von der Eltz | 8/543 |
| 4,089,644 | 5/1978 | Carbonell et al. | 8/400 |
| 4,125,371 | 11/1978 | Beutler et al. | 8/400 |

FOREIGN PATENT DOCUMENTS

| | | |
|---|---|---|
| 503684 | 6/1952 | Belgium . |
| 2624176 | 12/1977 | Fed. Rep. of Germany . |
| 2209007 | 6/1974 | France . |
| 2320381 | 3/1977 | France . |
| 1448269 | 9/1976 | United Kingdom . |
| 1488862 | 10/1977 | United Kingdom . |

OTHER PUBLICATIONS

Friese, H., Textilveredlung, 1978, 13, (No. 7), pp. 249–251.

*Primary Examiner*—A. Lionel Clingman
*Attorney, Agent, or Firm*—Sprung, Horn, Kramer & Woods

[57] ABSTRACT

Process for dyeing cellulose fibres and textile materials containing cellulose fibres with water-soluble reactive dyestuffs by the exhaustion method, characterized in that it is carried out using dye liquors, the particular fibre-reactive reactive dyestuff content of which is less than 10% of the total content of fixed dyestuff in the end dyeing.

8 Claims, No Drawings

PROCESS FOR DYEING CELLULOSE MATERIALS WITH REACTIVE DYESTUFFS BY THE EXHAUSTION METHOD

The invention relates to a process for dyeing cellulose fibre materials with water-soluble reactive dyestuffs in the presence of salt and alkalis by the exhaustion method, for example in winch vats, jet-dyeing units, hank dyeing machines and circulating liquor apparatuses.

The process is characterised in that it is carried out using dye liquors, the particular dyestuff content of which is not greater than the amount of dyestuff which is necessary to produce on the fibre a difference in depth of colour which is visible as unevenness. Thus, when dyeing cellulose fibres with reactive dyestuffs by the process according to the invention, within a given time $\Delta t$, dyestuff is in each case made available to the fibre, in the form of small portions $\Delta s$, only in an amount which can be fixed chemically by the fibre in this time under the given pH, salt and temperature conditions. The process according to the invention is thus in opposition to the existing concept that a level dyeing can be achieved all the more easily the higher the dyestuff concentration in the dyebath, and that it is more highly probable that dye liquors with a low dyestuff content give dyeings which are more uneven than is the case with dye liquors with a high dyestuff content. The amount of dyestuff which produces a colour difference which is still visible is $<10\%$, in particular 3–8% and preferably 4–6%, of the total dyestuff consumption of the dyeing.

It has been found, surprisingly, that when cellulose fibres are dyed with dye liquors which contain the reactive dyestuff and in which the total amount of reactive dyestuff necessary to achieve the desired depth of colour is not present all at the same time but is metered into the liquor in small portions over the entire dyeing period, a better levelness can be achieved than in the case of the customary procedure in which the dyestuff is added to the bath before the fixing conditions are achieved and is then fixed on the fibre in the manner customary for reactive dyestuffs by increasing the pH value, by increasing the temperature or by adding salt.

The process is carried out by adding salt and alkali to the dye liquor in the customary manner and then incorporating the dyestuff in the main stream of the circulating dye liquor over at least $\frac{2}{3}$ of the entire dyeing period.

The process can also be carried out by a procedure in which not only the dyestuff but also the alkali required for carrying out the fixing reaction are fed continuously to the bath, simultaneously or independently, or in which the dyestuff is fed continuously to the bath during the first half of the dyeing period and the alkali is then fed continuously to the bath during the second half of the dyeing period.

Winch vats which are suitable for the process according to the invention are those which have a liquor circulation independent of the movement of the goods, as is the case with jet-dyeing units and circulating liquor apparatuses.

Reactive dyestuffs which are suitable for the process according to the invention are dyestuffs of the azo, anthraquinone and phthalocyanine series which contain at least one fibre-reactive group and sulphonic acid groups. It is particularly advantageous to use the process with dyestuffs which have a high substantivity and which, as a result of their migration being too low, tend to give uneven dyeings under the dyeing conditions hitherto customary.

Migration is understood as the ability of a reactive dyestuff to migrate, during the dyeing operation, from areas on the fibre with a relatively high concentration of dyestuff to areas on the fibre with a relatively low concentration of dyestuff, as has been described by M. Aoyagi and E. Ogawa in Japan Textile News, July 1977, pages 95–98. Reactive dyestuffs with a high substantivity are understood as those which have, in equilibrium, a substantive exhaustion of the bath of at least 50% on bleached cotton at 40° in the presence of 50 g/l of sodium sulphate.

Examples of suitable dyestuffs which may be mentioned are those which contain at least one mono- or dichlorotriazinyl or monofluorotriazinyl group or at least one mono- or di-fluoropyrimidinyl,sulphatoethylsulphonyl, ethylsulphonylbenzothiazolyl or 2,3-dichloroquinoxalinylcarbonyl group and which are used for dyeing by the exhaustion method in the temperature range of 30°–100° and at a pH of 9–12, and in the presence of 10–100 g/l of a salt.

Fibre materials which are particularly suitable for the claimed process are those which, as a result of their high affinity, cannot be used to give level dyeings reliably and in a reproducible manner by conventional processes in which the dyestuff is made available to the goods at a high initial concentration. Such fibre materials preferably consist of cotton or staple viscose which has been mercerised as hanks or in the piece.

A further advantage of the process according to the invention is that it is also possible to use those reactive dyestuffs which cannot usually be used or can be used only for light shades because of their inadequate maximum solubility in the presence of sodium chloride. Furthermore, higher salt concentrations than are customary can be employed in the process claimed without the dyestuff precipitating and thus leading to blotches on the goods, that is to say to dyeings which cannot be utilised. In this manner, with the same amount of dyestuff, greater utilisation of the dyestuff employed and hence better profitability are achieved.

However, compared to the dyeing procedure hitherto customary, the process claimed also gives higher colour yields if the same amounts of salt are used.

A surprising advantage of the process is the improvement of simultaneous absorption of reactive dyestuffs of different substantivity. Whilst the substantive dyestuff is preferentially absorbed in conventional dyeing processes and thereby leads, on material of high affinity, to an uneven appearance of the goods, with the process according to the invention it is also possible to achieve level dyeings with those dyestuffs which, because of their different absorption, tend to produce not only differences in depth of colour but also differences in colour shade.

Unless otherwise indicated, the parts mentioned in the following examples are parts by weight. The structures of dyestuffs I–V used in the examples are given in the table following the examples. Temperature data are in degrees Centigrade.

EXAMPLE 1

100 parts of a knitted cotton fabric are drawn into a commercially available jet-dyeing unit, and this is charged with 700 parts of water of 25° and 1.4 parts of sodium bicarbonate. 0.4 part of sodium di-(2-ethylhexyl)

phosphate is then added and the liquor is warmed to 45°, with good circulation of the fabric and liquor.

When this temperature has been reached, 35 parts of solid sodium chloride are added. After 15 minutes, two solutions are continuously added dropwise independently of one another, in the course of two hours, to the circulating dyebath thus prepared. One solution consists of 60 parts of water and 4 parts of the dyestuff I and the other solution consists of 40 parts of water and 0.5 part of sodium hydroxide.

After the dropwise addition, the unit is left to run for a further 10 minutes at the temperature established and, after draining off the residual liquor, the fabric is then rinsed with cold water and warm water and soaped at the boil, in the customary manner.

A level red dyeing is obtained.

EXAMPLE 2

100 parts of a knitted cotton fabric mercerised in the piece are drawn into a commercially available winch vat with liquor circulation, and 1,300 parts of water of 25° and 1.5 parts of sodium dihydrogen phosphate are added. The resulting liquor is then warmed to 80°, with good circulation, and 120 parts of solid sodium sulphate are added to the dyebath. After leaving the vat to run at 80° for 10 minutes, two solutions are continuously added dropwise independently of one another, in the course of 1 hour, to the dyebath thus prepared. One solution consists of 96 parts of water, 1 part of the dyestuff I, 1.5 parts of the dyestuff II and 1.5 parts of the dyestuff III.

The second solution consists of 99.7 parts of water and 0.3 part of sodium hydroxide. After the dropwise addition, the fabric is treated at 80° for a further 10 minutes and the liquor is then drained off and the resulting dyeing is rinsed with cold water and hot water and soaped at the boil, in the customary manner. A level brown dyeing is obtained.

EXAMPLE 3

100 parts of knitted cotton fabric mercerised in the piece are drawn into a commercially available jet-dyeing unit and this is charged with 1,400 parts of water of 25°, 1.5 parts of 1,3-bis-(ethylhexyl)-glycerol ether-2-sulphate and 0.8 part of sodium bisulphate. The liquor is then warmed to 70°, with good circulation of the fabric and liquor, and during the heating, 140 parts of solid sodium chloride are added.

When the temperature has reached 70°, the unit is left to run at this temperature for 10 minutes and then gradually cooled to 45° in the course of 120 minutes. During the cooling, 2 solutions are continuously injected into the rapidly circulating liquor, independently of one another, with a slowly increasing rate of addition. One solution consists of 2 parts of the dyestuff IV, 0.2 part of sodium dihydrogen phosphate and 50 parts of water and the other solution consists of 1 part of sodium hydroxide in 50 parts of water.

After the dropwise addition, the fabric is treated at 45° for a further 20 minutes and then rinsed and soaped at the boil, in the customary manner. A level red dyeing is obtained.

EXAMPLE 4

100 parts of cotton yarn are treated on a commercial yarn dyeing apparatus for 15 minutes with 1,000 parts of an aqueous liquor, warmed to 80°, containing 50 parts of sodium chloride. 100 parts of a solution containing 3.5 parts of the dyestuff V and 2.5 parts of sodium bicarbonate are then pumped in continuously at the above temperature in the course of 2 hours with the aid of a commercially available metering pump. After this period, the apparatus is left to run for a further 5 minutes and the yarn is then rinsed with cold water and warm water and soaped at the boil, in the customary manner. A level green dyeing is obtained.

I

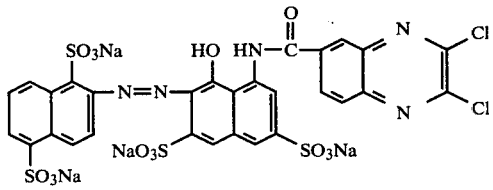

II

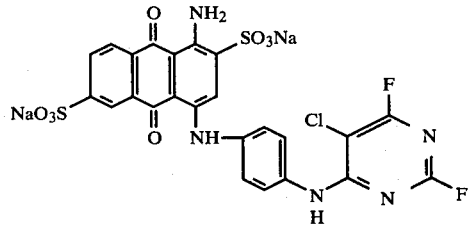

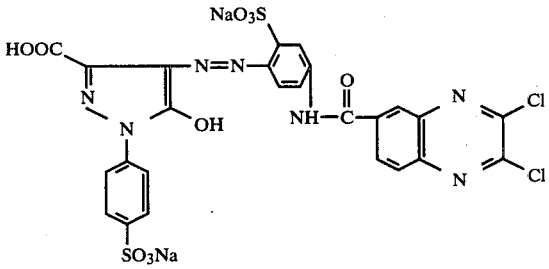

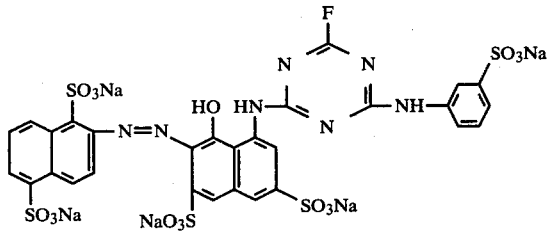

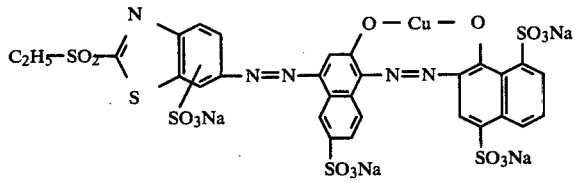

I claim:

1. Process for dyeing cellulose fibres and textile materials containing cellulose fibres with water-soluble reactive dyestuffs by the exhaustion method, characterised in that it is carried out using dye liquors, the particular fibre-reactive reactive dyestuff content of which is less than 10% of the total content of fixed dyestuff in the end dyeing.

2. Process according to claim 1, characterised in that it is carried out using dye liquors, the particular fibre-reactive reactive dyestuff content of which is less than 6% of the total content of fixed dyestuff in the end dyeing.

3. Process according to claim 1 or 2, characterised in that the reactive dyestuff is fed continuously, in the form of an aqueous solution, to the dyebath over a period of ½–3 hours.

4. Process according to any one of claims 1 to 3, characterised in that the reactive dyestuff is fed continuously, in the form of an aqueous solution, to the dyebath over a period of 1 to 2 hours.

5. Process according to any one of claims 1 to 4, characterised in that the reactive dyestuff is fed continuously, in the form of its aqueous solution, to a dyebath having a pH value of 8–12, over a period of 1 to 2 hours.

6. Process according to any one of claims 1 to 4, characterised in that the reactive dyestuff and the alkali necessary for fixing the dyestuff are fed in simultaneously and independently of one another.

7. Process according to any one of claims 1 to 4, characterised in that the reactive dyestuff and the alkali required for fixing the dyestuff are fed in simultaneously in the form of an alkaline solution of the dyestuff.

8. Process according to any one of claims 1 to 7, characterised in that it is carried out using dye liquors, the pH value of which rises continuously from pH 7 to pH 12.

* * * * *